US009013114B2

(12) United States Patent
Archenhold

(10) Patent No.: US 9,013,114 B2
(45) Date of Patent: Apr. 21, 2015

(54) POWER CONTROL SYSTEM FOR AN ILLUMINATION SYSTEM

(71) Applicant: Radiant Research Limited, Aldridge, West Midlands (GB)

(72) Inventor: Geoffrey Howard Gillett Archenhold, Sutton Coldfield (GB)

(73) Assignee: Radiant Research Limited, Aldridge (GB)

( * ) Notice: Subject to any disclaimer, the term of this patent is extended or adjusted under 35 U.S.C. 154(b) by 164 days.

(21) Appl. No.: 13/762,694

(22) Filed: Feb. 8, 2013

(65) Prior Publication Data

US 2013/0214697 A1 Aug. 22, 2013

(30) Foreign Application Priority Data

Feb. 8, 2012 (GB) ..... 1202212.5

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 37/02* (2013.01); *H05B 33/0845* (2013.01)

(58) Field of Classification Search

CPC ..... H05B 33/0815; H05B 33/0818; H05B 41/2828; H05B 41/34; B23H 1/022; B23K 9/0637

USPC ..... 315/291, 171

See application file for complete search history.

(56) References Cited

U.S. PATENT DOCUMENTS

| | | | | |
|---|---|---|---|---|
| 8,324,822 | B2 * | 12/2012 | Peng | 315/209 R |
| 2007/0097574 | A1 | 5/2007 | Mahin et al. | |
| 2008/0202312 | A1 * | 8/2008 | Zane et al. | 84/297 R |
| 2009/0187925 | A1 | 7/2009 | Hu et al. | |
| 2011/0043133 | A1 | 2/2011 | Van Laanen et al. | |
| 2011/0080110 | A1 | 4/2011 | Nuhfer et al. | |
| 2011/0175532 | A1 * | 7/2011 | Peng | 315/119 |
| 2012/0032605 | A1 * | 2/2012 | Peng | 315/219 |
| 2012/0043889 | A1 * | 2/2012 | Recker et al. | 315/86 |

(Continued)

FOREIGN PATENT DOCUMENTS

| | | | |
|---|---|---|---|
| EP | 2315497 | A1 | 4/2011 |
| WO | 2004057924 | A1 | 7/2004 |
| WO | 2011092606 | A1 | 8/2011 |

*Primary Examiner* — Dylan White

(74) *Attorney, Agent, or Firm* — Bishop Diehl & Lee, Ltd.

(57) ABSTRACT

A power control system for an illumination system has a power source to supply any one of a range of AC or DC voltages, a power conversion stage, one or more light emitting device(s) for illumination and/or wireless communication, a controller controlling an output stage to receive and send information to regulate the power and/or current to the light emitting device(s), and a programmable voltage clamping or linear regulator arrangement contained within the output stage that can be controlled to increase a dynamic dimming ratio of current and/or power through the light emitting device(s) and to enable power or current modulation for wireless optical communication of light emitting device(s). The power control system enables current and power to be provided to one or more attached light emitting device(s) with a vastly extended dynamic dimming range such that different light emitting devices can be powered using the same driver output stage(s).

21 Claims, 9 Drawing Sheets

(56) References Cited

U.S. PATENT DOCUMENTS

2012/0043900 A1* 2/2012 Chitta et al. ..... 315/201
2012/0119669 A1* 5/2012 Melanson et al. ..... 315/247
2012/0153869 A1* 6/2012 Sadwick et al. ..... 315/307
2013/0038227 A1* 2/2013 Yan et al. ..... 315/186
2013/0293139 A1* 11/2013 Sadwick et al. ..... 315/224
2014/0077713 A1* 3/2014 Otake et al. ..... 315/200 R

* cited by examiner

Figure 1: Prior Art

POWER CONTROL SYSTEM FOR AN ILLUMINATION SYSTEM

CROSS-REFERENCE TO RELATED APPLICATIONS

This application claims the benefit of UK Patent Application No. 1202212.5 filed on 8 Feb. 2012, which is incorporated herein by reference.

TECHNICAL FIELD OF THE INVENTION

The present invention relates to improvements in methods and apparatus to power light sources, and in particular but not exclusively, relates to a method and apparatus to dim or otherwise adjust brightness or regulate the power to light sources such as Light Emitting Diodes (LEDs), Organic Light Emitting Diodes (OLEDs) and other Solid-State Light (SSL) source loads based upon organic or inorganic light emission mechanisms. The present invention also relates to improvements in methods and apparatus to provide a means of data transfer via the power control circuit to the light sources to provide both an illumination means and an optical communications network means for transmitting information using said light sources and a means for receiving information.

The use of SSL light sources such as LEDs and OLEDs in lighting systems is well known as they offer significant advantages over traditional light sources such as higher efficacy, increased reliability due to their solid-state nature and increased longevity amongst many other advantages known to those familiar in the area of LEDs and OLEDs.

(O)LEDs are used in a wide variety of configurations for general and specific illumination applications including, but not limited to task lighting, accent lighting, emergency lighting, hospitality lighting, restaurant lighting, hospital lighting, office lighting, retail lighting, automotive lighting, street lighting, amenity lighting, effect lighting, marine lighting, display case lighting, TV, film and projection lighting, entertainment lighting, animal and food production lighting, medical lighting, outdoor lighting, backlighting of displays, irradiation of micro-organisms in fluids using UV, curing and setting in industrial processes, corridor lighting, security lighting and the like.

BACKGROUND OF THE INVENTION

LEDs and OLEDs are current-controlled devices where the intensity of light emitted from the device is related to the amount of current driven through the device. It is therefore highly advantageous to carefully and reliably control the amount of current flowing through the LED or OLED device(s) in order to achieve the desired illumination effect from an illumination system and to maximise the life of a device by ensuring the maximum current or power specifications are not exceeded. In addition it is well known that the switching or modulation speed of LED and OLED devices are fast enough to enable their use as data transmitters in combination with the primary use of illumination.

(O)LED power supply systems have been developed based on a variety of circuit design topologies which provide the ability to vary the actual or time-averaged forward current through the light emitting device load over an acceptable range in order to provide dimming capabilities. (O)LED illumination systems have been devised which, through the use of multiple light emitting devices having discrete wavelengths/colours, can produce a variety of colours and intensities. Systems incorporating Red, Green, Blue, Amber and White light emitters can create near infinite colour variations by varying the intensity, current or power of each of the coloured light emitter(s) individually or together in combination. The use of multiple discrete wavelengths in the illumination system provides the opportunity to increased data transfer rate from the light emitting devices by using different photon energies multiplexed simultaneously to increase system bandwidth.

SUMMARY OF THE INVENTION

According to a first aspect of the invention, there is provided a power control system for an illumination system comprising:

- a power source to supply any one of a range of AC or DC voltages;
- a power conversion stage;
- one or more light emitting device(s) for illumination and/or wireless communication;
- a controller for controlling an output stage to receive and send information in order to regulate the power and/or current to the light emitting device(s);
- a voltage clamping or linear regulator arrangement contained within the output stage that can be controlled to increase the dynamic dimming ratio of current and/or power through the light emitting device(s) and to enable power or current modulation schemes for wireless optical communication of said light emitting device(s).

By incorporating such a power control system it is possible to provide current and hence power to one or more attached light emitting device(s) with a vastly extended dynamic dimming range enabling a wide range of different light emitting devices including single die emitter packages, single array packages containing multi die emitters or multiple packages to be powered using the same driver output stage(s). Single or multiple light emitting packages may contain one or more light emitting elements capable of radiating a single colour which includes white, or a plurality of colours and preferably has a modulation bandwidth at −3 db greater than 2 MHz.

The power control system is able to utilises the best efficiency power stage according to the power demand on the output stage thus maximising the efficiency across the whole dimming current (or power) range. Switching regulators currently available offer high efficiencies (80%-99%) at maximum output power. However, as the output power is decreased down to zero, the switching stage is not able to accurately and repeatedly provide an output current to the light emitting device(s). This results in unstable current or power though the output load(s) which results in an undesirable visual flickering of the light emitters. The present invention is able to maintain stability of the switching regulator continuously even at very low output powers by clamping the voltage of the output stage as the output power is reduced.

Light emitting devices currently available may range from a few hundred milliwatts of power right up to a few hundred or thousands of watts depending on the configuration of the illumination system. Each of the light emitting devices within the illumination systems require different forward voltages and forward currents in order to operate correctly and the present invention enables the output drive stage to be easily configured using a microprocessor (or similar device) making it more suitable to drive a greater range of illumination systems.

Combining the unique features of a switching regulator with an output driver stage containing a controller such as a microprocessor or similar device, load controlling a voltage clamp and/or a linear stage circuit enables a very wide dynamic dimming (or power) ratio to be achieved and it is possible to have a 1 to 4294967296 (232 using 32 bits) range. Although a 28 bit or 256 dynamic range is fine for many lighting applications there is a growing requirement to provide small absolute current (power) steps for the first few control protocol bits. Increased dimming (or power) resolution enables illumination systems to offer exponential dimming curves that are pleasing to the human eye and mimic the dimming effects seen by traditional light sources such as incandescent bulbs. The present invention enables the precise linear or non-linear dimming of light emitting devices to very low illumination levels irrespective of drive current profile through the light emitting devices.

A further advantage of the present invention is that it offers a low cost and simple means of incorporating a high frequency modulation scheme onto the output stage of the controller enabling information in the form of data to be optically transmitted through the light emitting devices at high speeds.

Traditional switching regulators or control systems for solid state lighting do not offer such high speed transmission of information through their light emitting devices because the SMPS control loops are not fast enough to transmit information meaningfully. The present invention can be implemented simply in both single stage and multi-stage, isolated or non-isolated SMPS topologies with very little increase in component count or cost.

Other features of the invention are defined in the dependent claims and may be further discussed hereinafter.

It may be that the power conversion stage includes either a linear or switch mode power supply. It may be that the switch mode power supply can provide one or more DC output voltages or currents through one or more of the following:

Flyback convertor
Ringing Choke convertor
Half-Forward convertor
Forward convertor
Resonant forward convertor
Push-pull convertor
Half-Bridge convertor
Full-Bridge convertor
Resonant, zero voltage switched convertor
Isolated Cuk convertor It may be that an AC to DC topology includes one or more of the following:

Input and output power terminal blocks
Excess input voltage protection means
Input noise filter means
Rectifier and current limiter
Power Factor Correction
Power bank
Output current limiter, power limiter, voltage regulator, thermal shutdown, short circuit protection
Output noise and ripple filter
Standby, low power or shutdown means It may be that a fundamental switching frequency can be between 20 KHz and 1 MHz.

It may be that the power control system comprises:

at least one AC to DC switch mode power supply;
one or more output driver stages containing either a high modulation bandwidth voltage controlled current source or voltage clamp to modulate the current or power suitable for data transmission through the connected light emitting device(s);
a means for ensuring the high modulation bandwidth data output is rejected or attenuated by the switch mode power supply to ensure stable current or power output is maintained;
a means for providing internal and external control commands to the controller from or to a high bandwidth data control network;

It may be that the power conversion stage can stably operate over a wide light emitting device current range especially at currents <1% of maximum output stage current.

It may be that the power control system is configured to dynamically configure the duty cycle and fundamental switching frequency of one or more switch mode regulators. It may be that the power control system is configured to provide linear or non-linear current or power profiles over a quantized time interval to the light emitting device(s).

It may be that the voltage clamping or linear regulator arrangement is capable of injecting high bandwidth current or voltage signals onto the output stages of the power convertor to provide a wireless photonic data transfer rate between 1 kbps and 100 Gbps through the connected light emitting device(s).

It may be that the output drive stage(s) are capable of delivering a current to one or more light emitting device(s) with a magnitude down to 100 nanoAmpere in a controlled manner.

It may be that the light output characteristic can be controlled by one or more of the following:

an optical wireless signal received from a remote transceiver;
an RF wireless signal received from a remote transceiver;

It may be that the light emitting device contains at least one high power (>0.1 W) solid-state light source.

It may be that the illumination system contains at least one high bandwidth light sensitive device.

It may be that the output stage can deliver power to one or more light emitting devices using pulsed, non-pulsed or analogue current profiles either exclusively or combined.

It may be that the current profile through the light emitting device is selected from Direct Current, Alternating Current, Pulse Width Modulation, Pulse Amplitude Modulation, Pulse Frequency Modulation, Pulse Density Modulation, Delta Sigma Modulation, Stochastic Signal Density Modulation (SSDM), and Amplitude Modulation.

At least one embodiment of the present invention includes a means for a power conversion stage which includes controlling the power factor and the quality of power to the illumination system. It may be that the power factor of the switch mode power supply unit used within one embodiment of the illumination system is ≥0.80, more preferably ≥0.98, so that, once the power is delivered to the device load, the amount of current returned is minimised.

A power factor correction (PFC) circuit may be employed in the invention when used with AC signal in to DC signal out topologies to precisely control the input current on an instantaneous basis, to match the waveshape of the input voltage. The PFC circuit may contain active and/or passive power factor correction to ensure the illumination system has a power factor correction greater than 0.8.

The quality of power delivered to the illumination system can affect the overall lifetime characteristics of the system. For example, significant voltage spikes that occur from the power providers transmission lines could result in partial or catastrophic failure of the light emitting source (in the case of a direct AC LED) or the power control system (in the case of a DC LED system). Therefore in one or more embodiments of this invention a power line conditioner topology is utilised to improve the quality of the power that is delivered to the illumination system.

At least one embodiment of the present invention utilises a light emitting device that contains at least one high power (>0.1 Watt) (O)LED emitter package that may contain one or more light emitting elements. The (O)LED emitter package may be of a type that can be energised using either a DC or AC voltage depending on user or system requirements. The (O)LED emitter package(s) may be arranged into an ordered or pseudo-ordered array of light emitters in order to optimise the light exiting the illumination system.

It may be that the power control system is able to utilize a microprocessor, programmable system on a chip (PSoC), FPGA (Field Programmable Gate Array), ASIC (Application Specific Integrated Circuit) or any other alternative integrated circuit device that is capable of computing information or data to calculate control parameters of the light emitting device. Furthermore, said power control system is preferably able to utilize and implement feedback and feedforward control systems to rapidly react to information provided by feedback or optical sensors in order to modulate the characteristics of the light emitting device(s). Such feedback sensors could include but is not limited to optical, colour, light intensity, temperature, timer, occupancy, current, voltage, power, gas, magnetic, vibration, acceleration, velocity, frequency and biological means of monitoring or detecting environmental conditions.

According to a second aspect of the invention, there is provided a system according to the first aspect of the invention wherein said illumination system incorporates light emitting device(s) comprising single or multiple light emitting packages containing one or more light emitting elements capable of radiating photons in a narrow wavelength band, or a wide wavelength including white, or a plurality of photons within the visible or non-visible electromagnetic spectrum.

The light emitting device(s) may comprise one or more (O)LED strings. In at least one embodiment, the light emitting device comprises at least two (O)LED strings comprising a string of (O)LEDs that emit a first wavelength spectrum within the visible range and a string of (O)LEDs that emit a second wavelength spectrum in the non-visible range.

According to a third aspect of the invention, there is provided a power source wherein said power source could be either or a combination of a high or low voltage AC or DC energy source. The AC power supply range may vary from a few voltages of AC input to 1000 volts of alternating current whilst the DC voltage input may vary from a few volts of direct current to more than 1000 volts DC depending on the electrical and electronic configuration of the power control system.

The power source may be powered by a power supply or transformer that is preferably attached directly or remotely to the illumination system. The power source may be an AC to DC power supply, a DC to DC power supply, an AC to AC power supply or any other suitable power supply.

According to a fourth aspect of the invention, there is provided a single stage switch mode power supply wherein the said topologies provide safety, component value and temperature variation compensation methods including one or more of the following features: current limiting, foldback, thermal shutdown, safe area protection, over current, short circuit or output power protection.

According to a fifth aspect of the invention, there is provided a voltage clamping circuit arrangement that is able to clamp the output of the switch mode power supply to enable a microprocessor to remain energised even when there is little or no power consumed by the output load.

The voltage clamp arrangement may take the form of either a DC voltage clamp or an AC voltage clamp in either a unbiased, negatively or positively biased operation. The voltage clamping may be achieved using a simple zener diode configuration or more complex IC arrangements such as using operational amplifiers.

The power control system may be capable of measuring the output drive stage current, voltage and power consumption in either a continuous conduction or non-continuous conduction mode using the advanced microprocessor or integrated circuit device and control sensor values. Utilizing a microprocessor to control or regulate the output drive stage enables sophisticated control algorithms to be implemented in real-time.

According to a sixth aspect of the invention, there is provided a means for a switch mode regulator wherein the control circuit further comprises:

- an integrated circuit, microprocessor or any other similar semiconductor means to generate the switch control signal;
- a means for measuring the current flowing through the light emitting device;
- a means for measuring the voltage present across the light emitting device;
- a means for receiving light emitting device characteristics such as light intensity, power spectral density, light emitting device temperature;
- a means for receiving sensor information;
- a means for transceiving information across a control network, sensor network, user interface and/or an optical communication system which incorporates the light emitting device for illumination and a high bandwidth light sensitive device.

In this aspect of the invention, it is possible to modulate the current flowing through the light emitting device using the combination of a current sense resistor in series with the light emitting device and modulating a high frequency signal on the current flowing through the light emitting device using either the voltage clamping circuit or a high speed linear regulator stage attached to the main switching output stage.

In this aspect of the invention, it is possible to measure the switching regulator output voltage and hence derive the forward voltage across the light emitting device connected to the power control system using a simple potential divider or emitter-follower topology connected to regulator output stage. The emitter follower may be designed to use a simple transistor such as the BC846C with input and output bias resistors to appropriately set the gain of the emitter follower arrangement which can then be used to provide a voltage feedback value to the power control system.

According to a seventh aspect of the invention, there is provided a means for a power control system wherein said power control system is able to configure the switching frequency of the one or more switch mode regulators dynamically to provide a single fundamental frequency or continuously varying fundamental switching frequency according to the desired output characteristics of the load or light emitting device(s).

The fundamental switching frequency can be between 20 KHz and 1 MHz.

According to an eighth aspect of the invention, there is provided a means for a power control system wherein the light output characteristic of the illumination system can be controlled by one or more of the following:

- an optical wireless signal received from a remote transceiver;
- an RF wireless signal received from a remote transceiver;

According to a ninth aspect of the invention, there is provided a means for a power control system wherein the output drive stage(s) are capable of delivering a current to one or more light emitting device(s) with a magnitude down to 100 nanoAmperes in a controlled manner.

According to a tenth aspect of the invention, there is provided a means for a power control system wherein the output drive stage(s) are capable of operating over a wide dynamic current range with a maximum range limit selected by the microprocessor or other integrated circuit device from $2^1$ to $2^{32}$ bits.

According to an eleventh aspect of the invention, there is provided a means for a power control system, wherein the output stage can deliver power to one or more light emitting devices using pulsed, non-pulsed or analogue current profiles either exclusively or combined wherein the current profile (or power) through the light emitting device may be Direct Current, Alternating Current, Pulse Width Modulation, Pulse Amplitude Modulation, Pulse Frequency Modulation, Pulse Density Modulation, Delta Sigma Modulation, Stochastic Signal Density Modulation (SSDM), Amplitude Modulation or any other current control technique known to those in the art.

The feature(s) according to the different aspects of the invention may be employed separately or in combination with any other feature(s) described herein including, but not limited to, any feature(s) according to other aspects of the invention.

The present invention will now be described, by way of example, with reference to the accompanying drawings.

DETAILED DESCRIPTION

Figure 1:
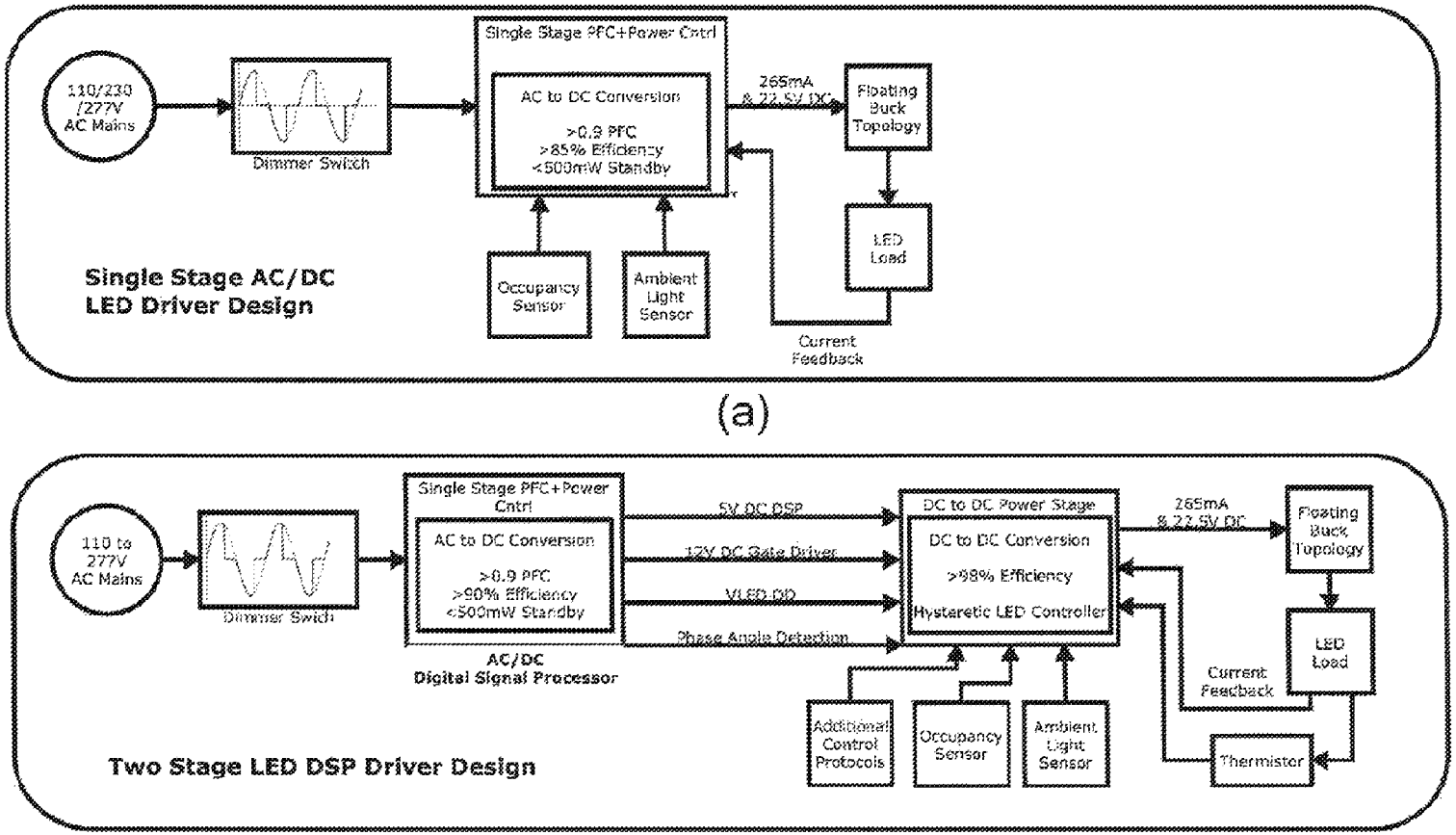
FIGS. 1*a* and 1*b* illustrate prior art switching regulator circuit topologies including a single stage design (FIG. 1*a*) and a two stage design with separate PFC and Power controller stages (FIG. 1*b*)

FIG. 1*a* shows a prior art single stage AC/DC (O)LED driver design schematic that contains a single PFC and Power controller stage that controls the current to an (O)LED load using a floating buck topology and a means for load current feedback. A dimmer switch may be used to transfer dimming information to the (O)LED driver design in order to reduce the current or power through the connected (O)LED load to make it visually dim in intensity.

FIG. 1*b* shows a typical prior art two stage AC/DC (O)LED driver design. Here the system has a first stage that provides PFC and power control similar to that shown in FIG. 1*a* however there is a second DC/DC power conversion stage which enables improved output regulation and control to the (O)LED load.

Figure 2:
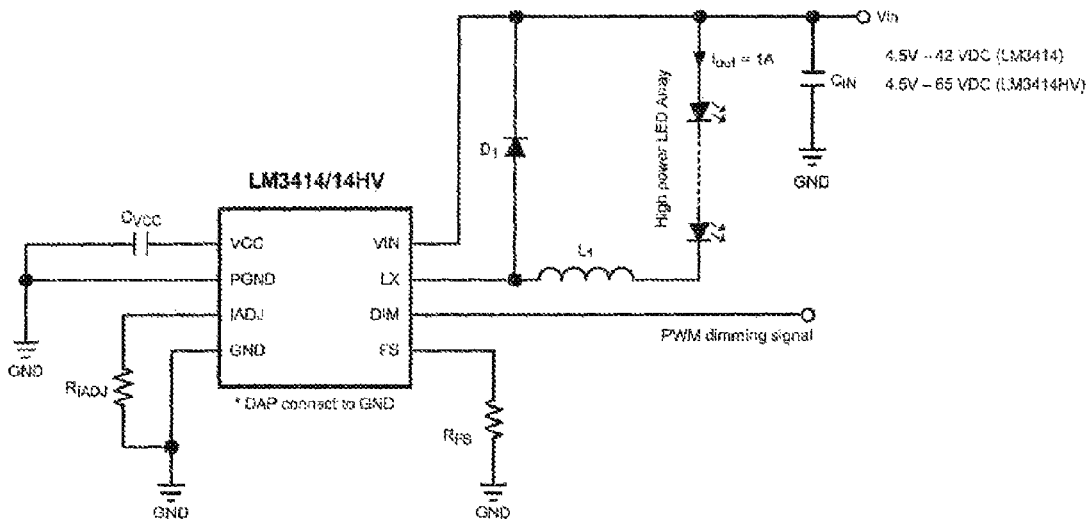
Figure 2 Prior Art
FIG. 2 illustrates a prior art switching regulator circuit with analogue and PWM dimming inputs to dim the current through LEDs.

FIG. 2 illustrates a prior art DC/DC switching regulator circuit with analogue and PWM dimming inputs to dim the current through the high power LEDs. The switching regulator is only able to dim down to 10% of full load power.

Figure 3:
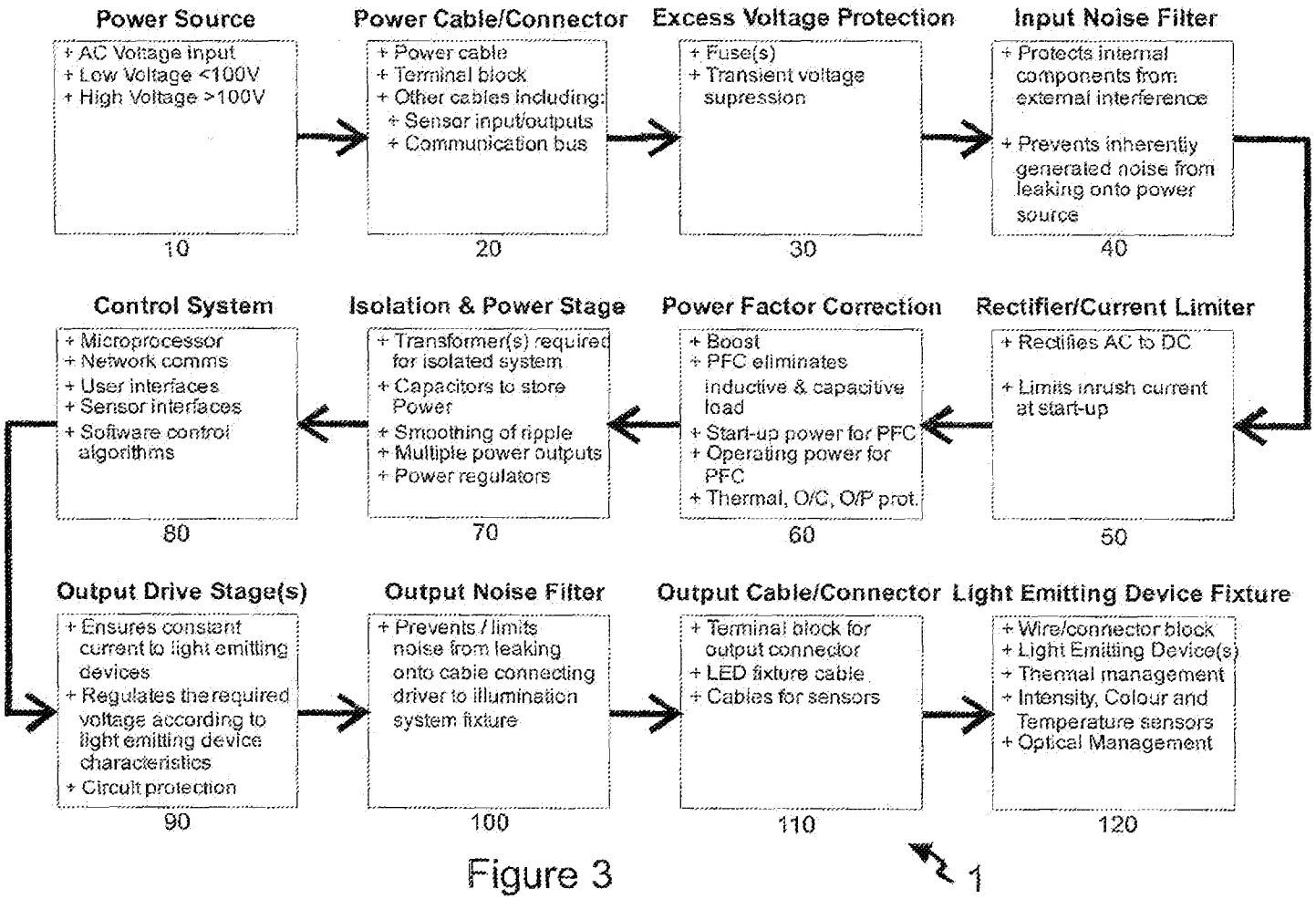
FIG. 3 illustrates a schematic diagram outlining the main design aspects of the illumination system of one embodiment of the present invention.

FIG. 3 illustrates a schematic diagram outlining the main parts of an illumination system from input to output according to one embodiment of the present invention. As mentioned, the object of an AC to DC illumination system (1) is to supply a prescribed power in the form of an output voltage and constant current to a light emitting device fixture to modulate the light output accordingly.

This is achieved with a power source (10) being connected by a power cable (20) to a power terminal block (21) which in turn is connected to excess voltage protection (30) and an input noise filter (40) prior to rectification and current limiting (50). The rectified stage (50) is connected to a power factor correction means (60) followed by an isolation and power stage (70) providing the required parameters to enable the dynamic control system (80) to operate. The dynamic control system (80) is connected to the output drive stage(s) (90) that is in turn connected to an output noise filter (100) which ensures that constant current with a minimum of noise is given to the output connector (110) and cable (111) which a light emitting device fixture (120) is connected to.

All of the modules mentioned above comprise components that are connected to each other via one or more dedicated printed circuit boards (PCB) or cables.

Each of the modules will be explained in more detail below:

The power source module (10) of the illumination system (1) could be either a high voltage (>100V) or low voltage (<100V) AC power source and is connected by a suitably rated power cable (26) to a terminal block (21) within the power cable/connector module (20) that could be either panel mounted or PCB mounted. The terminal block (21) may be a multiple pole type to enable multiple drivers to be linked simply together. Depending on the configuration of the illumination system (1) other cables could be connected to the same or different terminal block (21) representing various sensor inputs (22) or output (23) as well as communication bus (24) for communicating instructions between the illumination system (1) and a master controller (2). The communication bus may be based on a variety of hardware or protocol systems such as I2C, SPI, UART, RS232, RS485, DMX CAN, USB, IEE1394, DMX, RDM, KNX, DALI, 802.11b/n, Bluetooth, Zigbee, Ethernet readily available within digital communication systems The excess voltage protection module (30) may comprise of one or more fuses (31) in either or both power supply phase inputs to improve safety. The fuses (31) are included to protect against short circuits to earth on the respective phases, or a short circuit between phases. Furthermore, in at least one embodiment, there is also excess voltage protection at the input that consists of transient protection. It is known that transient spikes from the power source module (10) can damage sensitive components. The best form of transient voltage suppression is to implement a transient voltage suppressor (32) which will efficiently protect the rest of the illumination system (1) from transient voltage spikes.

The input noise filter module (40) has two main functions. The first is to prevent inherently generated noise from the switching regulators within the switch mode power supply of the illumination system (1) from returning into the power source (10) grid network. There are international standards to regulate how much noise can be generated by electronic products. The second function of the input filter is to stop noise from the power source (10) grid network entering into the power supply of the illumination system (1). The filter usually contains components on both the input and output sides of the rectifier module (50).

The rectifier module (50) must be present on an AC to DC power system since most commercially available (O)LEDs are usually driven by direct current. The input side of the rectifier module (50) converts the AC power source into a DC rectified source. In at least one embodiment, the rectifier module (50) provides a means for giving the illumination system (1) a soft-start feature by limiting the inrush current at the start-up phase. Limiting the current taken by the illumination system (1) in the start-up phase is important for determining the safe value ratings for cables, fuses and other components.

The power factor correction module (60) is a core feature of a modern AC to DC power supply as it reduces the inductive and capacitive load on the power source module (10). The PFC module (60) provides a boost in the output voltage which is an important feature to enable many light emitting devices to be driven. In one embodiment of the PFC module (60) the PFC Integrated Circuit is driven by a start-up current derived from the output stage of the rectifier module (50) and during normal operation is driven by an operating current which takes over once the PFC module (60) circuit has started up. The latest PFC integrated circuit controllers provide power factor correction close to 1 and offer over temperature, over current and over power protection on the primary side of the switch mode power supply.

The isolation and power stage (70) is usually connected to the output stage of the PFC module (60) and contains capacitors that are large enough to absorb and smooth out ripple currents exiting from the PFC module (60) whilst providing direct voltage to the dynamic control system (80) and output drive stage (90) modules. One embodiment of the isolation and power stage module (70) would provide one or more regulated voltages to the control system (80) in order to optimise the efficiency of the switch mode power supply. A further embodiment provides a transformer to provide galvanic isolation of the output from the high voltage inputs.

The control system module (80) is powered from the voltage supply outputs of the isolation and power stage module (70). One embodiment of the control system module (80) incorporates a microprocessor (81) executing software control algorithms, a means for communicating via a bus (24) with a network master controller (2), one or more user interfaces (82) and one or more sensor interfaces (83). One embodiment of the user interface (82) would include a menu keypad and LCD display to enable users to determine the output control functions of the illumination system (1). A further embodiment would be a web-based user interface on a portable or fixed computing device.

In a one embodiment of the illumination control system (1) the output drive stage module (90) is controlled by the control system (80) to ensure a constant current and delivers a voltage that is dependent on the number of light emitting devices used within the light emitting device fixture (120). At least one embodiment of the digital control system (80) incorporates the output drive stage module (90) to reduce the cost and size whilst increasing efficiency.

In one embodiment the output noise filter (100) includes an inductive and capacitive load which removes ripple and noise spikes at the output drive stage module (90). Since the light emitting devices require stable voltages in order not to be overloaded by high ripple voltages, the output noise filter (100) will ensure the conducted and radiated noise emissions on or from the output cable (112) connected to the light emitting device fixture (120) are attenuated.

The output cable and connector module (110) contains a terminal block for the output connector (111). The output cable (112) provides power to the light emitting device fixture (120) and also one or more cables to carry signals from sensors.

In one embodiment the light emitting device fixture (120) contains a wire or connector block (121) to provide power from the output cable (112) of the switch mode power supply, a heatsink (123) that is thermally connected to a metal core PCB containing lighting emitting devices (124) or (O)LED array substrate, a temperature sensor (125) to measure the temperature of light emitting device (124), a light intensity sensor (126) to measure the intensity of the ambient light and the output of the light emitting device (124), a colour sensor (127) to measure the colour of the light emitting device (124).

Figure 4:
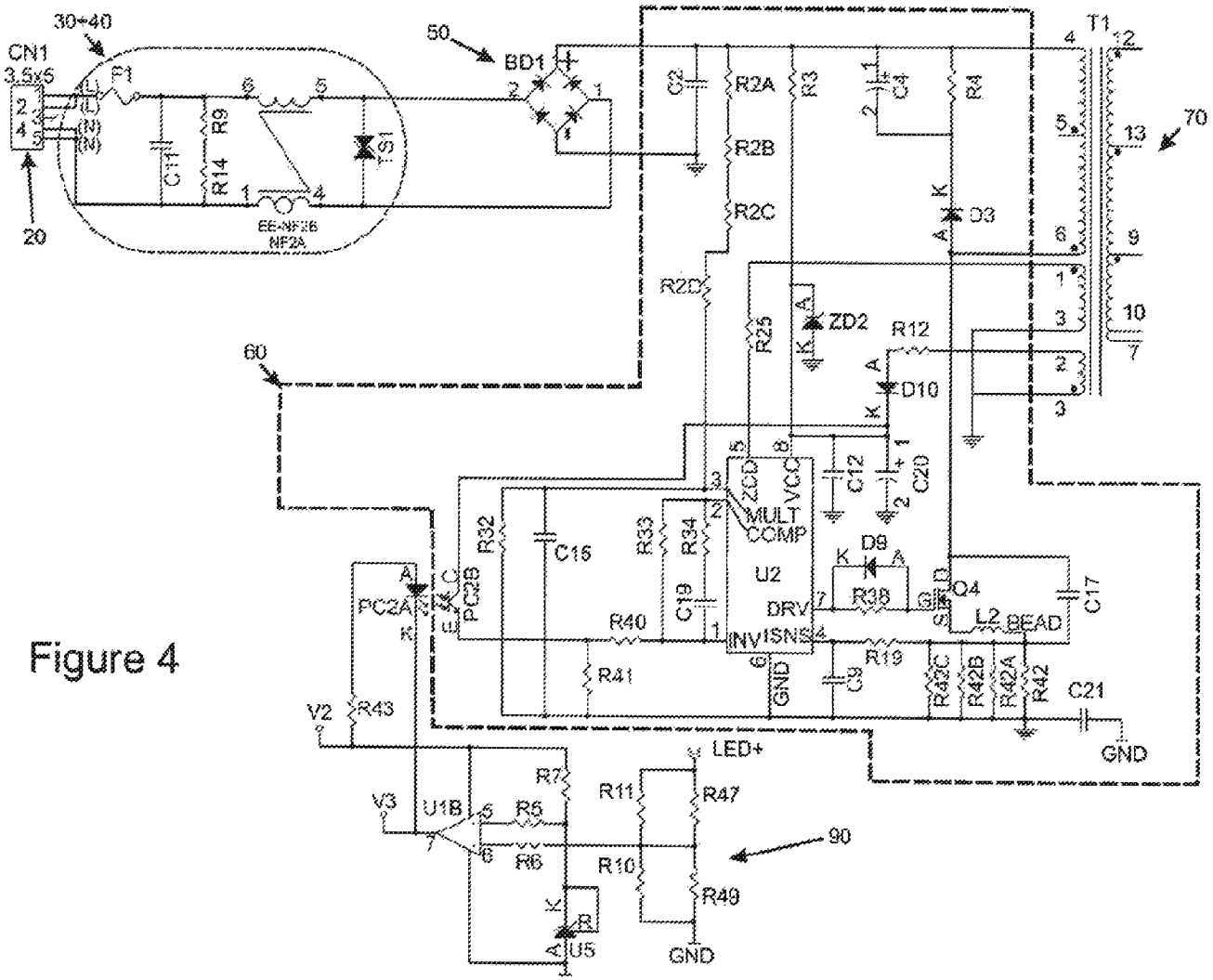
FIG. 4 illustrates one embodiment of a single stage configuration of the power control system outlining the isolated high voltage input side.

FIG. 4 illustrates an embodiment of a high efficiency, low cost, ultra wide dimming ratio single stage power control system that is capable of having a load current dimming ratio of at least 15000:1 using DC or constant current reduction. The system has a power connector terminal block (20) where mains power is supplied to the system. This is followed by a safety fuse (F1) and transient voltage suppressor (TS1) which is able to protect the embodiment in case of high input voltages or transient signals (30). An input filter in the form of a capacitor (C11), resistors (R9, R14) and inductor (NF2A/B) is shown to attenuate noise (40). A bridge rectifier (BD1) is used to rectify the incoming filtered power in a standard rectification stage (50) whilst a standard SMPS integrated circuit controller (U2) is used to create power factor correction and a boost power controller stage (60). The IC shown is an ST Micro L6562D PFC and PWM power controller however any similar type of single stage control topology may be used for this embodiment. The power to the isolation transformer (T1) is controlled using a switching MOSFET (Q4) which in-turn is controlled by the gate driver pin (DRV) of the IC controller (U1). The transformer (T1) forms part of an isolated flyback SMPS design (70). Feedback is provided from the secondary isolation side of the design (90) in order to control the SMPS power by using an opto-isolator (PC2A/B) however it is possible to use alternative methods of single stage control which do not require opto-isolators. For example, the LinkSwitch-PH family from Power Intergrations Inc, USA offer highly integrated monolithic switching devices that can implement a single stage topology without the use of an opto-isolator and secondary side feedback components.

Figure 5:
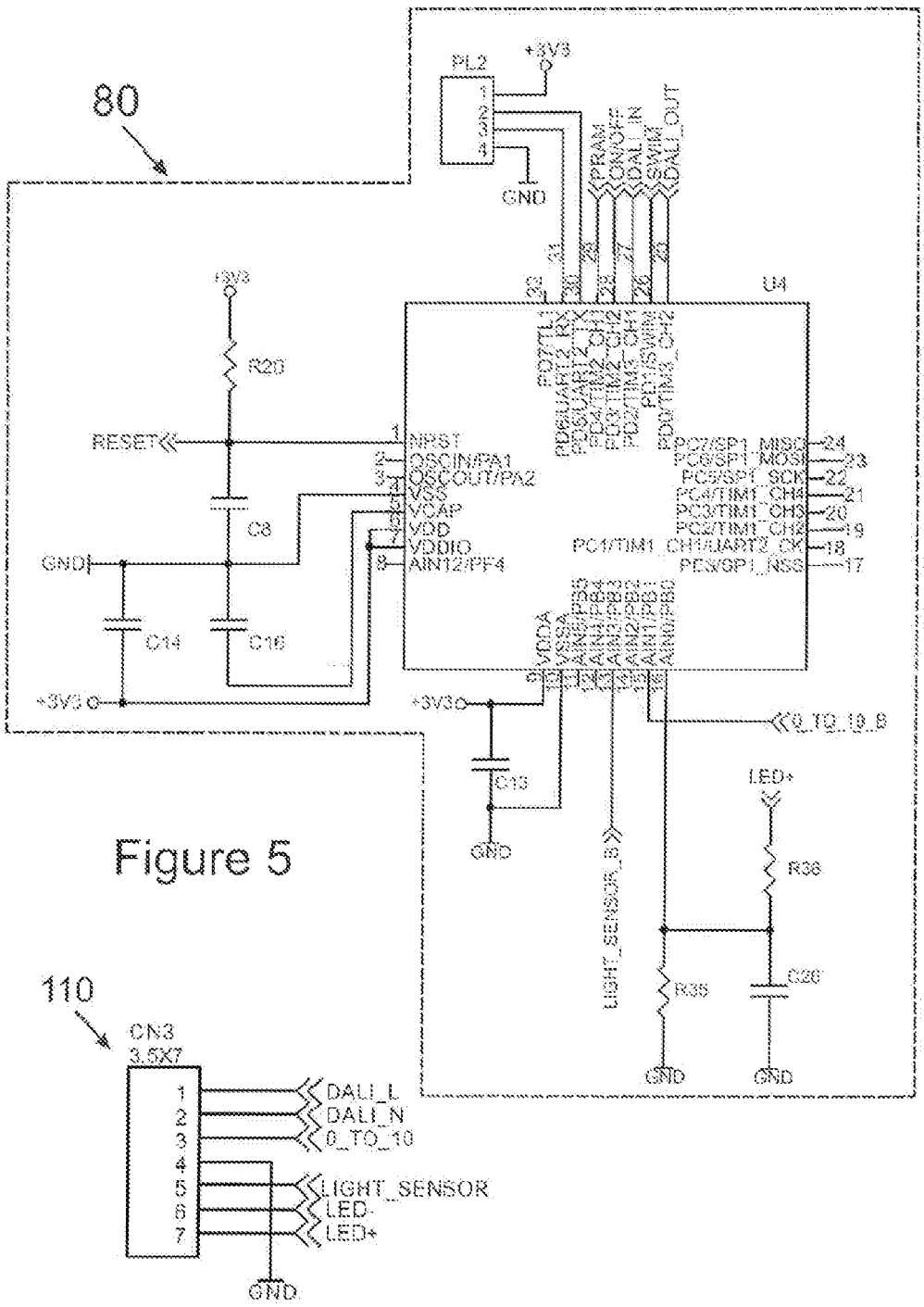
FIG. 5 illustrates the same single stage embodiment as outlined in FIG. 4 of a configuration of the power control system outlining the secondary output side of the design incorporating a zener based voltage clamp and microprocessor control system.
Figure 5:
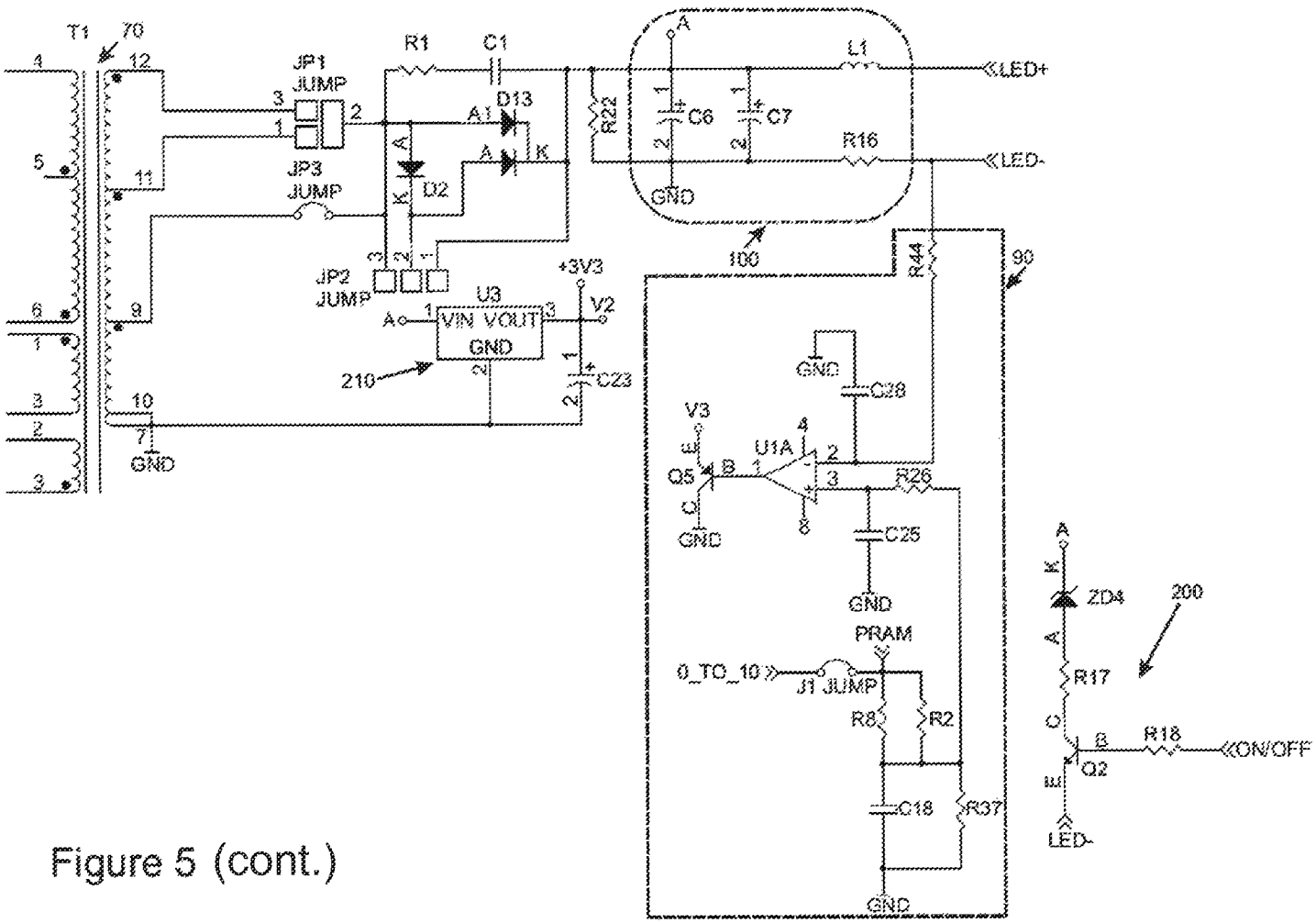

FIG. 5 illustrates the same embodiment as outlined in FIG. 4 however it describes the secondary side circuit which is galvanomically isolated from the high voltage primary side by the transformer (T1) and opto-isolators shown in FIG. 4. An output noise filter arrangement (100) which prevents or limits switching noise from leaking onto the output of the SMPS is created with the use of capacitors (C6 and C7) along with an inline inductor connected to the anode terminal (LED+) of the light emitting diode. The output filter reduces the ripple current and limits fast transients that could cause harm to the light emitting device(s) or cause the control system to fail EMC requirements. The output connector (110) contains a terminal block (CN3) for connecting the power control system (1) to the light emitting device(s), control/data interfaces and sensors. This particular embodiment accepts 0V to 10V and DALI control protocol standards to enable dimming. The control system (80) utilises a low power, low cost microcontroller (U4) which in this embodiment is an STM8 microprocessor from ST Microelectronics although any similar Integrated Circuit maybe used. The microprocessor is able to control the output stage (90) and provide a very wide dynamic dimming ratio utilising a control signal (PRAM). The control system (80) is powered directly from the output stage of the SMPS utilising a linear regulator (U3) which in this case is defined as an LM29150. The linear regulator (U3) could be replaced with a DC/DC switching regulator to improve efficiency of the power supply to the microprocessor (U4) when the output voltage of the power stage is significantly larger than that of the microprocessor supply. Usually, the microprocessor control system (80) is powered from a separate transformer or winding in order for the power supply to the microprocessor to remain stable no matter what the output stage condition. This however causes extra complexity of the transformer (T1) which adds costs and also reduces overall efficiency of the system. In such as single stage topology SMPS design the voltage on the output stage will become unstable when there is no load applied or the current to the load is switched off as the PFC and power controller IC (U2) does not need to energise the transformer (T1). This output stage instability would normally cause the microprocessor control system (80) and microcontroller (U4) to reset making it impossible to control the system accurately.

Several prior art SMPS designs add dummy loads to the output stage in order to maintain stability by mimicking a load to keep the PFC and Power controller (60) pulsing energy into the transformer (T1) however this reduces the overall efficiency of the SMPS as there is wasted energy dissipated in the dummy load and excessive heating can reduce the life of the power supply.

This embodiment uses the inherent power consumption of the control system (80) as a load on the SMPS output without wasting any additional energy and keeping the system efficiency high. The control system (80) load placed on the SMPS output drive stage (90) provides a current offset into the system which increases the actual dynamic dimming ratio of the SMPS system.

The output driver stage(s) (90) ensure constant current is maintained to the light emitting devices however this necessitates the output stages (90) can vary the output voltage widely. Therefore, the current embodiment uses a voltage clamping mechanism (200) to maintain a stable output voltage of the driver stage(s) (90) irrespective of the type and number of light emitting device(s) connected to the output stage. The microprocessor (U4) controls the voltage clamp according to a variety of parameters including but not limited to the output voltage of the SMPS, the output current of the driver stage(s) (90) and if there is a load connected or not. The voltage clamp may be constructed from a Zener Diode (ZD4) in an emitter follower arrangement using a transistor (Q2) and resistors (R17 and R18) across the light emitting device(s). The use of the voltage clamp ensures that when there is no load connected to the output drive stage(s) or the control system microprocessor (U4) switches the output to 0 A or "OFF" the power supply (U3) to the microprocessor (U4) remains stable at all times. This topology is very inexpensive to implement and only requires 4 additional components making it an ideal solution. In addition when there is a load connected to the output stage(s) the voltage clamp may be switched off to preserve SMPS efficiency. Again, for those skilled in the art the voltage clamping topology may be implemented in different ways.

Figure 6:
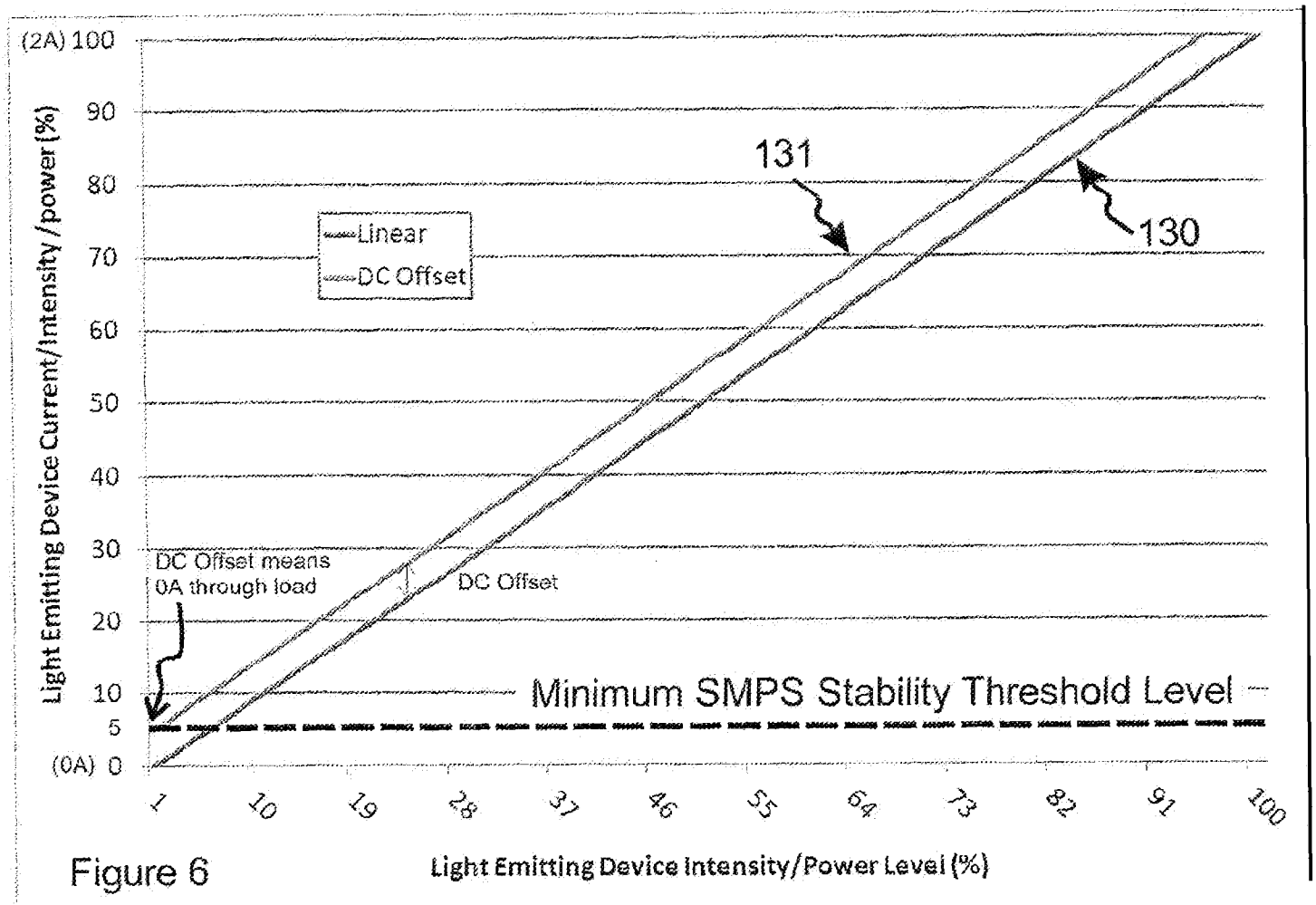
FIG. 6 illustrates a graph that outlines the minimum dimming performance of a standard power control system compared to that obtained by the proposed invention.

FIG. 6 illustrates the current offset created by operating the microprocessor (U4) directly off the output stage(s) that improves the current sense resolution of a system despite the use of low tolerance and inexpensive components. The graph shows how a standard single stage SMPS design (130) reduces the output current (from 2 A to 0 A) through a light emitting diode(s) load according to a user desired output dimming intensity. In this embodiment the output dimming intensity curve is linear however any type of curve may be defined and used in such a system.

For any given single stage SMPS topology there is a defined minimum output stability level which is determined by the various component tolerances and minimum feedback errors associated with the SMPS topology. Once the desired output current drops below the minimum stability level the SMPS becomes unstable and the output current will fluctuate unpredictably resulting in visible flicker to the human eye which is highly undesirable. As described previously this embodiment provides a current offset that means the SMPS system will remain stable even if the light emitting device(s) load does not have current going through it as the minimum light emitting device(s) load of 0 A remains above the minimum stability level set by the SMPS topology. Therefore, this embodiment of the invention is able to provide accurate and repeatable dimming right down to 0 A. Although it is possible to increase the quality of components and their tolerances within an SMPS topology to improve the minimum stability level achievable the cost of implementation would make the system commercially uncompetitive compared to the current invention and it may be even less attractive than designing a two stage design with improved performance.

Figure 7A:
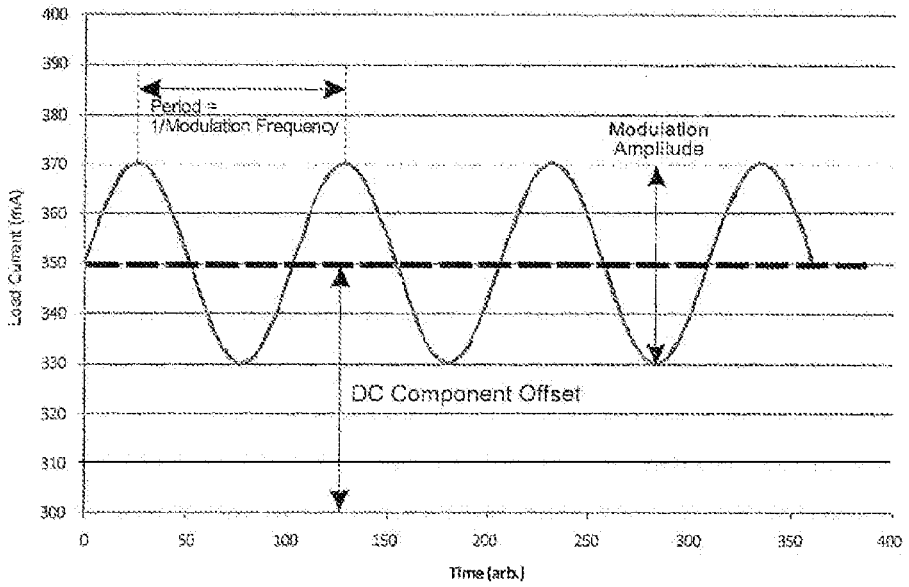
FIG. 7*a* illustrates a graph that defines the output current characteristics (DC current offset, current ripple amplitude and current ripple frequency) of typical switch mode power supplies.
Figure 7B:
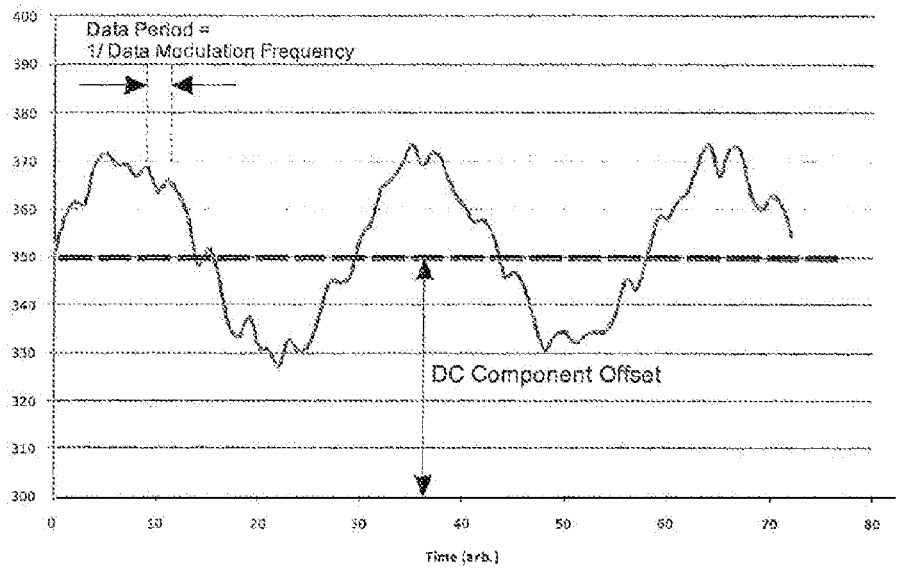
FIG. 7*b* illustrates a graph which includes the additional current data modulation which can be used for visual lighting communications applications on a typical switch mode power supply.

FIG. 7*a* show a typical output current waveform from either a single stage or multi-stage SMPS that defines ripple current parameters including the ripple modulation amplitude and the ripple modulation frequency. Even if a SMPS provides an essentially DC output current to the light emitting diodes there will still remain components of the switch mode power supply on the output. Typical SMPS ripple current ranges from 10% at the best to over 90% at worst for DC based output stages and if pulsing of current such as that used by PWM based system is employed then the ripple current is deemed 100%. This SMPS component usually exists a ripple on the output current cause by the fundamental or second harmonic of the switching frequency of the stage. The ripple usually contains a DC component and a modulating amplitude AC component which has a modulation frequency. For SMPS designs used with mains dimmer switches as outlined in FIG. 1 the output ripple frequency is usually 100 Hz or 120 Hz or 2× the standard mains input power frequency. One embodiment of the present invention is to utilise either the voltage clamp mechanism (200) as identified in FIG. 5 or a low cost high speed linear current sink or source circuit topology that provides a high frequency data information signal onto the current/power output stage. This high frequency output signal as shown in FIG. 7*b* would enable the light emitting diode load(s) connected to the output stage(s) to vary the intensity proportionally to variations in the amplitude of the load current/power. Such optical variations can be easily picked up by receivers connected to or integrated with networked devices to transmit information. Usually such types of equipment are exclusive to applications where cost is not the first consideration as the equipment required to create the optical network is prohibitively expensive however present invention teaches how the main light emitting devices of an illumination system can be multiplexed to act as a data transmitter using a very low cost but elegant solution. What is important to note is that the solution is able to operate providing the data modulation signal is sufficiently higher than the modulation caused by the SMPS stages as shown in FIG. 7*b*.

Figure 8A:
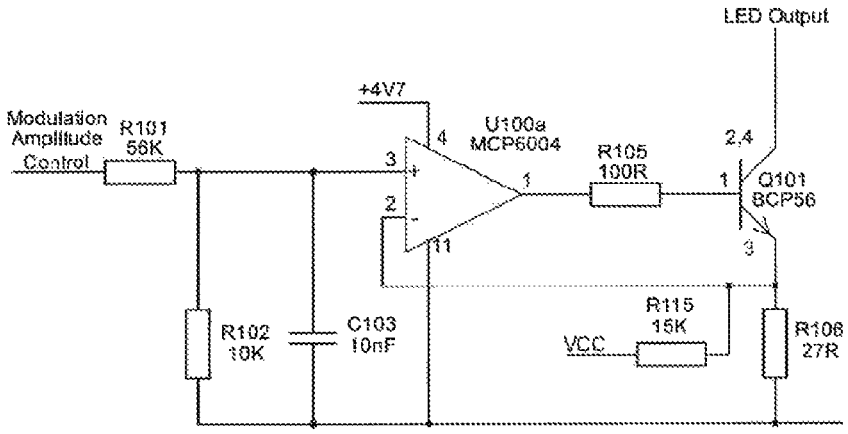
FIG. 8*a* illustrates an embodiment of a modulating voltage controlled current source that can be connected to the output drive stage of a switch mode power supply to enable data modulation.

FIG. 8*a* shows an embodiment where a low cost, low component, linear switching stage is implemented into a low cost single stage SMPS to provide modulation of current used on the output stage for data transfer using variations in light emitting device(s) output at high frequency. The topology is based on a standard voltage controlled current source where the output current is programmed by a voltage to the +ve input of the operational amplifier (U100*a*). The voltage presented to the operational amplifier has a low pass filter created by resistors (R101, R102) and capacitor (C103) which is created by a rapidly changing digital voltage signal (Modulation Amplitude Control). The maximum current amplitude is set at 20 mA for this example however it is possible to optimise this to any particular range.

Figure 8B:
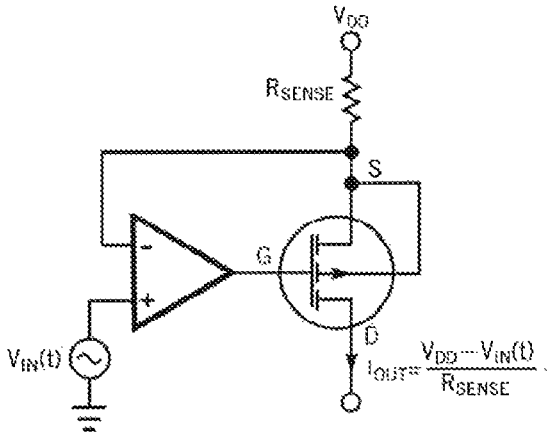
FIG. 8*b* illustrates a further embodiment of a high bandwidth voltage controlled current source that can be connected to the output drive stage of a switch mode power supply to enable data modulation.

FIG. 8*b* shows a further embodiment of a voltage controlled current source that can be used to modulated a current signal onto the SMPS output stage(s). The voltage control, VIN(t), can be created by a high speed Digital to Analogue Convertor (DAC) such as the Texas Instruments ADS58B18 ADC that is able to output at speeds of 200 million samples per second with a voltage resolution of 11 bits. Such fast current modulation rates will mean the SMPS control loop stability will not be affected as the current changes are outside of the main control loop bandwidth response. The output current magnitude, Iout, is determined by the voltage difference (Vdd−Vin(t)) divided by the sense resistor Rsense to enable the maximum current source amplitude to be set.

What is claimed is:

1. A power control system for an illumination system comprising:

a power source to supply any one of a range of AC or DC voltages;

a power conversion stage;

one or more light emitting device(s) for illumination and/or wireless communication;

a controller controlling an output stage to receive and send information in order to regulate the power and/or current to the light emitting device(s);

a programmable voltage clamping or linear regulator arrangement contained within the output stage that can be controlled to increase a dynamic dimming ratio of current and/or power through the light emitting device(s) and to enable power or current modulation for wireless optical communication of said light emitting device(s);

wherein said light emitting device(s) comprise single or multiple light emitting packages containing one or more light emitting elements capable of radiating a single colour which includes white, or a plurality of colours that has a modulation bandwidth at −3 db greater than 2 MHz.

2. A power control system according to claim 1 wherein said power conversion stage includes either a linear or switch mode power supply.

3. A power control system according to claim 2 wherein said switch mode power supply can provide one or more DC output voltages or currents through one or more of the following:

Flyback convertor
Ringing Choke convertor
Half-Forward convertor
Forward convertor
Resonant forward convertor
Push-pull convertor
Half-Bridge convertor
Full-Bridge convertor
Resonant, zero voltage switched convertor
Isolated Cuk convertor.

4. A power control system according to claim 2 wherein said AC to DC topology includes one or more of the following:

Input and output power terminal blocks
Excess input voltage protection means
Input noise filter means
Rectifier and current limiter
Power Factor Correction
Power bank
Output current limiter, power limiter, voltage regulator, thermal shutdown, short circuit protection
Output noise and ripple filter
Standby, low power or shutdown means.

5. A power control system according to claim 2 wherein the fundamental switching frequency can be between 20 KHz and 1 MHz.

6. A power control system according to claim 1 wherein said power control system comprises:

at least one AC to DC switch mode power supply;

one or more output driver stages containing either a high modulation bandwidth voltage controlled current source or voltage clamp to modulate the current or power suitable for data transmission through the connected light emitting device(s);

a means for ensuring the high modulation bandwidth data output is rejected or attenuated by the switch mode power supply to ensure stable current or power output is maintained;

a means for providing internal and external control commands to the controller from or to a high bandwidth data control network.

7. A power control system according to claim 1 wherein said power conversion stage can stably operate over a wide light emitting device current range especially at currents <1% of maximum output stage current.

8. A power control system according to claim 1 wherein said power control system is configured to dynamically configure the duty cycle and fundamental switching frequency of the one or more switch mode regulators.

9. A power control system according to claim 1 wherein said power control system is configured to provide linear or non-linear current or power profiles over a quantised time interval to the light emitting device(s).

10. A power control system according to claim 1 wherein said voltage clamping or linear regulator arrangement is capable of injecting high bandwidth current or voltage signals onto the output stages of the power convertor to provide a wireless photonic data transfer rate between 1 kbps and 100 Gbps through the connected light emitting device(s).

11. A power control system according to claim 1, wherein the output drive stage(s) are capable of delivering a current to one or more light emitting device(s) with a magnitude down to 100 nanoAmpere in a controlled manner.

12. A power control system according to claim 1, wherein the light output characteristic can be controlled by one or more of the following:

an optical wireless signal received from a remote transceiver;

an RF wireless signal received from a remote transceiver.

13. A power control system according to claim 1, wherein the light emitting device contains at least one high power (>0.1 W) solid-state light source.

14. A power control system according to claim 1, wherein the illumination system contains at least one high bandwidth light sensitive device.

15. A power control system according to claim 1, wherein the output stage can deliver power to one or more light emitting devices using pulsed, non-pulsed or analogue current profiles either exclusively or combined.

16. A power control system according to claim 15 wherein the current profile through the light emitting device is selected from Direct Current, Alternating Current, Pulse Width Modulation, Pulse Amplitude Modulation, Pulse Frequency Modulation, Pulse Density Modulation, Delta Sigma Modulation, Stochastic Signal Density Modulation (SSDM), and Amplitude Modulation.

17. A power control system for an illumination system comprising:

a power source to supply any one of a range of AC or DC voltages;

a power conversion stage;

one or more light emitting device(s) for illumination and/or wireless communication;

a controller controlling an output stage to receive and send information in order to regulate the power and/or current to the light emitting device(s); a programmable voltage clamping or linear regulator arrangement contained within the output stage that can be controlled to increase a dynamic dimming ratio of current and/or power through the light emitting device(s) and to enable power or current modulation for wireless optical communication of said light emitting device(s);

wherein said power conversion stage includes either a linear or switch mode power supply; and wherein the fundamental switching frequency can be between 20 KHz and 1 MHz.

18. A power control system for an illumination system comprising:

a power source to supply any one of a range of AC or DC voltages;

a power conversion stage;

one or more light emitting device(s) for illumination and/or wireless communication;

a controller controlling an output stage to receive and send information in order to regulate the power and/or current to the light emitting device(s);

a programmable voltage clamping or linear regulator arrangement contained within the output stage that can be controlled to increase a dynamic dimming ratio of current and/or power through the light emitting device(s) and to enable power or current modulation for wireless optical communication of said light emitting device(s);

wherein said power conversion stage can stably operate over a wide light emitting device current range especially at currents <1% of maximum output stage current.

19. A power control system for an illumination system comprising:

a power source to supply any one of a range of AC or DC voltages;

a power conversion stage;

one or more light emitting device(s) for illumination and/or wireless communication;

a controller controlling an output stage to receive and send information in order to regulate the power and/or current to the light emitting device(s);

a programmable voltage clamping or linear regulator arrangement contained within the output stage that can be controlled to increase a dynamic dimming ratio of current and/or power through the light emitting device(s) and to enable power or current modulation for wireless optical communication of said light emitting device(s);

wherein said power control system is configured to provide linear or non-linear current or power profiles over a quantised time interval to the light emitting device(s).

20. A power control system for an illumination system comprising:

a power source to supply any one of a range of AC or DC voltages;

a power conversion stage;

one or more light emitting device(s) for illumination and/or wireless communication;

a controller controlling an output stage to receive and send information in order to regulate the power and/or current to the light emitting device(s);

a programmable voltage clamping or linear regulator arrangement contained within the output stage that can be controlled to increase a dynamic dimming ratio of current and/or power through the light emitting device(s) and to enable power or current modulation for wireless optical communication of said light emitting device(s);

wherein said voltage clamping or linear regulator arrangement is capable of injecting high bandwidth current or voltage signals onto the output stages of the power convertor to provide a wireless photonic data transfer rate between 1 kbps and 100 Gbps through the connected light emitting device(s).

21. A power control system for an illumination system comprising:

a power source to supply any one of a range of AC or DC voltages;

a power conversion stage;

one or more light emitting device(s) for illumination and/or wireless communication;

a controller controlling an output stage to receive and send information in order to regulate the power and/or current to the light emitting device(s);

a programmable voltage clamping or linear regulator arrangement contained within the output stage that can be controlled to increase a dynamic dimming ratio of current and/or power through the light emitting device(s) and to enable power or current modulation for wireless optical communication of said light emitting device(s);

wherein the output drive stage(s) are capable of delivering a current to one or more light emitting device(s) with a magnitude down to 100 nanoAmpere in a controlled manner.

* * * * *